US009921032B2

(12) United States Patent
Donin De Rosiere

(10) Patent No.: US 9,921,032 B2
(45) Date of Patent: Mar. 20, 2018

(54) WEAPON EQUIPMENT AND PROJECTILE ESPECIALLY ADAPTED FOR SUCH WEAPON EQUIPMENT

(71) Applicant: CATHYOR ENGINEERING SA, Verbier (CH)

(72) Inventor: Yves Donin De Rosiere, Verbier (CH)

(73) Assignee: Cathyor Engineering S.A., Verbier (CH)

( * ) Notice: Subject to any disclaimer, the term of this patent is extended or adjusted under 35 U.S.C. 154(b) by 0 days.

(21) Appl. No.: 15/390,630

(22) Filed: Dec. 26, 2016

(65) Prior Publication Data

US 2017/0299328 A1 Oct. 19, 2017

(30) Foreign Application Priority Data

Dec. 30, 2015 (FR) ..... 15 63479

(51) Int. Cl.

| | |
|---|---|
| ***F41F 3/04*** | (2006.01) |
| ***F41F 1/06*** | (2006.01) |
| ***F42C 19/10*** | (2006.01) |
| ***F42C 19/08*** | (2006.01) |
| ***F42B 12/24*** | (2006.01) |

(52) U.S. Cl.

CPC ..... *F41F 1/06* (2013.01); *F42B 12/24* (2013.01); *F42C 19/0819* (2013.01); *F42C 19/10* (2013.01)

(58) Field of Classification Search

USPC ..... 89/1.813

See application file for complete search history.

(56) References Cited

U.S. PATENT DOCUMENTS

| | | | | |
|---|---|---|---|---|
| 3,134,330 A | | 5/1964 | Batou | |
| 4,458,598 A | | 7/1984 | Bornand | |
| 4,689,911 A | * | 9/1987 | White | F41A 19/39 42/1.06 |
| 5,228,855 A | * | 7/1993 | Frost | F42B 8/20 102/373 |

FOREIGN PATENT DOCUMENTS

| | | |
|---|---|---|
| DE | 102013010502 | 1/2015 |
| FR | 1589250 | 4/1970 |
| FR | 1326176 | 3/1973 |
| FR | 2488385 | 12/1982 |
| GB | 1207743 | 10/1970 |

OTHER PUBLICATIONS

Press Release, "Fly-K Mortar Systems—Excellent Stealth Capabilities and Tremendous Tactical Potential", XP002760779 (Rheinmetall AG Feb. 15, 2010).

* cited by examiner

*Primary Examiner* — Samir Abdosh
(74) *Attorney, Agent, or Firm* — James C. Lydon

(57) ABSTRACT

Weapon equipment including a launcher and a projectile, the projectile having an operating head, a tail and a weight between 750 g and 1000 g. The tail includes a tube made of an aluminum alloy having an inner diameter between 21.5 and 22.5 mm, a stroke between first and second locations between 110 mm and 120 mm, and a thickness in the vicinity of the first location between 4.6 mm and 5 mm, a piston movable between the first and second locations and defining with the tube a hermetically-sealed propulsion chamber, a propulsion charge placed in the propulsion chamber, the propulsion charge including a powder having a heat of combustion between 3500 J/g and 4000 J/g, the propulsion charge having a mass greater than 2.4 g and less than 3.7 g.

20 Claims, 6 Drawing Sheets

WEAPON EQUIPMENT AND PROJECTILE ESPECIALLY ADAPTED FOR SUCH WEAPON EQUIPMENT

FIELD OF THE INVENTION

The invention relates to weapon equipment and to a projectile specially adapted for such weapon equipment.

BACKGROUND OF THE INVENTION

In particular, the invention relates to weaponry equipment of the type comprising a launcher and at least one projectile intended to be projected at a distance by the launcher, wherein the launcher comprises:

- a cylindrical barrel along a barrel axis, with the barrel comprising a housing adapted to receive at least one portion of the projectile, and a mouth adapted to allow for a passage of the projectile,
- a launch rod extending in the housing of the barrel along the barrel axis and having a free end facing the mouth of the barrel, with the free end having a bearing surface and a recess arranged in the bearing surface,
- a percussion device comprising a percussion tip mounted to be movable in the launch rod between a retracted position, wherein the percussion tip is arranged in the recess, and a priming position, wherein the percussion tip protrudes in relation to the bearing surface, wherein the projectile has a weight between 750 g and 1000 g and extends along a projectile axis, with the projectile comprising an operating head and a tail which extends the operating head along the projectile axis, the tail comprising:

- a tube adapted to be mounted on the launch rod, with the tube being made from an aluminum alloy and having a cylindrical inner surface of circular section along the projectile axis, with the inner surface having a constant inner diameter over a stroke along the projectile axis between a first location located on a side of the operating head and a second location separate from the first location, the inner diameter being between 21.5 mm and 22.5 mm, in particular 22.05 mm, the stroke being between 110 mm and 120 mm, in particular 115 mm, with the tube having a thickness in the vicinity of the first location between 4.6 mm and 5 mm, in particular 4.8 mm,
- a sealing element closing the tube in a sealed manner in the vicinity of the first location,
- a piston placed in the tube in sealed contact with the inner surface of said tube and adapted to rest on the bearing surface of the free end of the launch rod, the piston comprising a primer arranged to be activated by the percussion tip in priming position when the piston is resting on the bearing surface of the free end of the launch rod, with the piston defining with the tube and the sealing element a hermetically-sealed propulsion chamber, with the piston being placed at the first location and able to be moved to the second location,
- a propulsion charge placed in the propulsion chamber when the piston is at the first location and able to be activated by the primer of the piston in order to move the piston bearing on the bearing surface of the free end of the launch rod from the first location to the second location, with the propulsion charge comprising a powder having a heat of combustion between 3500 J/g and 4000 J/g,

- a stopper element adapted to retain the piston in the tube at the second location.

Weapon equipment of this type corresponds to a mortar as a launcher and a grenade as a projectile operated by the company CATHYOR ENGINEERING S.A. under the name Fly-K®.

This weapon equipment, simple and light for an operator, makes it possible to contain the flame and the smoke resulting from the priming of the propulsion charge inside the hermetically-sealed propulsion chamber. These dispositions make it possible to suppress the light and to reduce the noise and the heat emitted during a firing. The firing is as such made difficult to detect by an enemy targeted by the firing not only with its bare senses but also with electronic detection devices, in particular infrared. The known weapon equipment provides great effectiveness due to its maneuverability, the maintaining of the operator safe that it provides for and the surprise effect that it can create.

The known weapon equipment is however limited to a maximum range of 650 m with an angle of inclination of the launcher of 45°. There is a need to increase this range, in particular up to 1000 m, while still preserving the effectiveness of the weaponry equipment.

BRIEF SUMMARY OF THE INVENTION

The invention aims to respond to this need.

To this end, according to a first aspect, the invention proposes a weapon equipment of the aforementioned type wherein the propulsion charge has a mass strictly greater than 2.4 g and less than 3.7 g, more preferably less than 3.6 g.

Hence, the projectile according to the invention makes it possible to increase the range of the weapon equipment in a simple manner, solely by increasing the propulsion charge in relation to the propulsion charge of the projectile operated under the name Fly-K®.

It is commonly admitted in the field of weaponry, that an increase of the propulsion charge is generally accompanied by a modification of the projectile and/or of the powder of the propulsion charge, in particular for choosing a powder having a less vivacity, i.e. having a lower heat of combustion. As such, the Manuel de rechargement No. 6 by René Malfatti, published in 2004 by Crépin Leblong, pages 43-45, stipulates that "for a same caliber, the vivacity of the powder has to decrease when the capacity of the cartridge case increases". In addition, the mass of the projectile according to the invention is greater than that of the projectile operated under the name Fly-K®. It is also commonly admitted in the field of weaponry that an increase in the mass of a projectile implies a decrease in the mass of the propulsion charge and/or a reduction in its vivacity. As such, the aforementioned Manuel de rechargement No. 6 stipulates, page 65, that "if, for a same type of powder and a same charge, a heavier projectile is used, the pressure rises; it is then necessary: either to reduce the charge, or to switch to a lower vivacity index".

The inventors have therefore gone against these technical prejudices and have observed that an increase in the propulsion charge alone made it possible to increase the range of the weapon equipment without damaging the launcher or risking affecting the integrity of the operator. In particular, the propulsion charge was able to be increased to be 3 g, which is 125% more than the propulsion charge of the projectile operated under the name Fly-K®, and up to 3.7 g, which is 155% more than the propulsion charge of the projectile operated under the name Fly-K®.

Without being bound by any theory, the characteristics of the tube of the tail of the projectile and, in particular, the elasticity of its material made it possible to resist the energy released during the priming of the propulsion charge.

The piston can have a recess opened towards the sealing element, and the powder of the propulsion charge can be entirely placed in the recess of the piston with a loading density between 0.9 g and 1.2 g par cm3. The increase in the propulsion charge can as such be carried out at a constant loading density in relation to the propulsion charge of the projectile operated under the name Fly-K®. The recess of the piston then has an increased volume in relation to volume of the recess of the piston of the projectile operated under the name Fly-K®.

The projectile can have a caliber of 51 mm.

The tube of the projectile can have opposite first and second ends in the vicinity of which the first and second locations are carried out.

In a complementary or alternative manner, the projectile can further include a body adjoining the head, with the head comprising an explosive charge and the body comprising a fragment-generating sleeve, with the fragment-generating sleeve being cylindrical along the projectile axis and having an inner surface, the inner surface being provided with first and second grooves extending respectively according to first and second secant directions.

The first grooves can be threads extending substantially circumferentially and the second grooves can be channels extending substantially axially.

When the projectile has a caliber of 51 mm, the fragment-generating sleeve can have an outer diameter of 51 mm and an inner diameter of 45 mm, and the inner surface of the fragment-generating sleeve can have threads carried out with a pitch of 4 mm and twenty to thirty channels.

The fragment-generating sleeve can be made of steel.

The launcher can be individual and able to be carried by hand by an operator.

According to a second aspect, the invention relates to a projectile specially adapted for a weapon equipment such as defined hereinabove, the projectile having a weight between 750 g and 1000 g and extending along a projectile axis, the projectile comprising an operating head and a tail that extends the operating head along the projectile axis, the tail comprising:

- a tube adapted to be mounted on a launch rod of a launcher, with the tube being made from an aluminum alloy and having a cylindrical inner surface of circular section along the projectile axis, with the inner surface having a constant inner diameter over a stroke along the projectile axis between a first location located on a side of the operating head and a second location separate from the first location, the inner diameter being between 21.5 mm and 22.5 mm, in particular 22.05 mm, the stroke being between 110 mm and 120 mm, in particular 115 mm, with the tube having a thickness in the vicinity of the first location between 4.6 mm and 5 mm, in particular 4.8 mm,
- a sealing element closing the tube in a sealed manner in the vicinity of the first location,
- a piston placed in the tube in sealed contact with the inner surface of said tube and adapted to rest on a bearing surface of a free end of the launch rod of the launcher, the piston comprising a primer arranged to be activated by a percussion tip in priming position of a percussion device of the launcher when the piston is resting on the bearing surface of the free end of the launch rod of the launcher, with the piston defining with the tube and the sealing element a hermetically-sealed propulsion chamber, with the piston being placed at the first location and able to be moved to the second location,
- a propulsion charge placed in the propulsion chamber when the piston is at the first location and able to be activated by the primer of the piston in order to move the piston bearing on the bearing surface of the free end of the launch rod of the launcher from the first location to the second location, with the propulsion charge comprising a powder having a heat of combustion between 3500 J/g and 4000 J/g,
- a stopper element adapted to retain the piston in the tube at the second location, wherein the propulsion charge has a mass strictly greater than 2.4 g and less than 3.7 g, more preferably less than 3.6 g.

BRIEF DESCRIPTION OF THE DRAWINGS

Other objects and advantages of the invention shall appear when reading the following description of a particular embodiment of the invention given by way of a non-limiting example, with the description given in reference to the annexed drawings wherein.

DETAILED DESCRIPTION OF THE INVENTION

In the figures, the same references designate identical or analogous elements.

Figure 1:
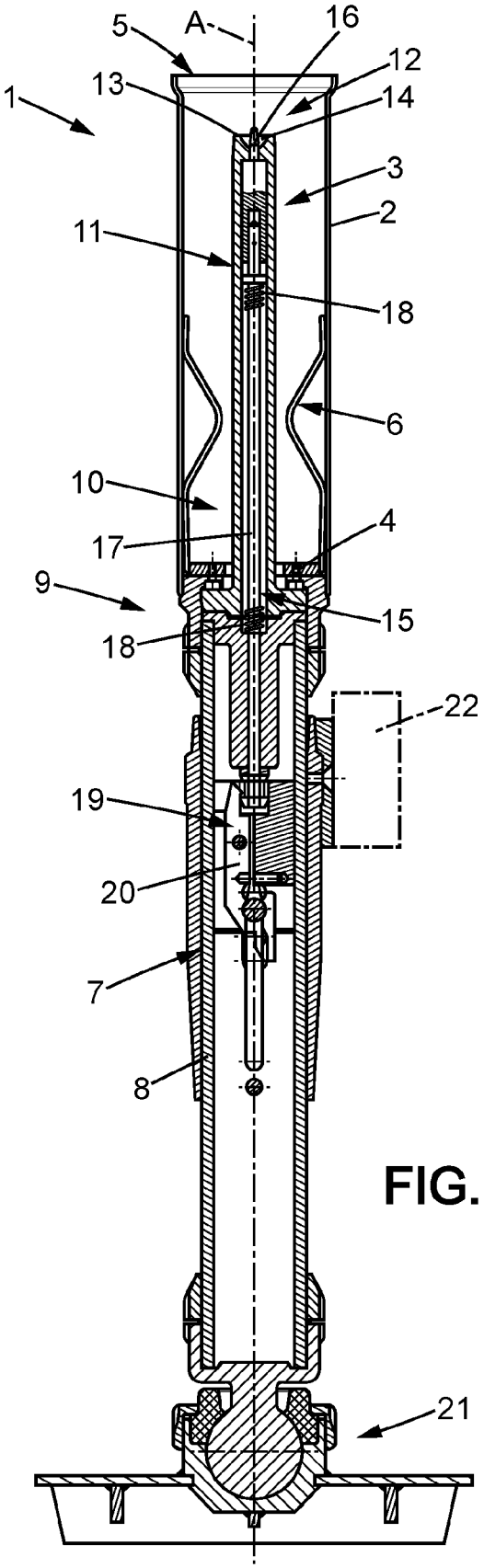
FIG. 1 shows a longitudinal cross-section of a launcher of a weapon equipment according to an embodiment of the invention.
Figure 2:
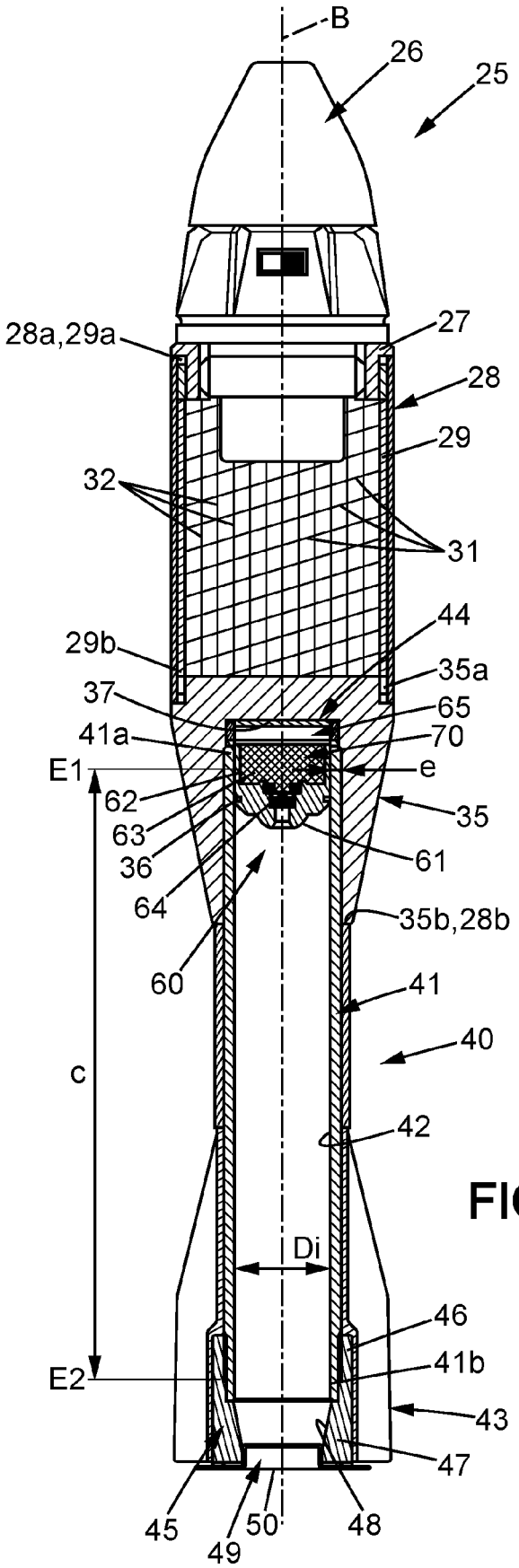
FIG. 2 shows a longitudinal cross-section of a projectile of the weapon equipment intended to be projected at a distance by the launcher of FIG. 1, FIGS. 3 and 4 show a longitudinal cross-section of alternatives of the projectile of the weapon equipment intended to be projected at a distance by the launcher of FIG. 1, FIGS. 5 and 6 show a longitudinal cross-section of the launcher of FIG. 1 and of the projectile of FIG. 2, respectively showing the projectile set in place in the launcher prior to a firing and the projectile in the process of leaving the launcher during the firing.

FIGS. 1 and 2 show an individual weapon equipment comprising a launcher 1 and one or several projectiles 25 intended to be projected at distance by the launcher 1.

In FIG. 1, the launcher 1 is an individual mortar and able to be carried by the main by an operator similar to the mortar operated by the company CATHYOR ENGINEERING S.A. under the name FLY-K®.

The launcher 1 comprises a cylindrical barrel 2 along a barrel axis A. The barrel 2 comprises a cylindrical housing 3 of circular section along the barrel axis A and adapted to receive a portion of the projectile 25. Alternatively, the housing 3 could be adapted to receive the entire projectile 25. The housing 3 extends from a bottom 4 of the barrel 2 and opens towards the outside opposite the bottom 4 by a mouth 5 adapted to allow for a passage of the projectile 25. A retaining device, in the form of one or several leaf springs 6, is provided inside the housing 3 in order to retain the projectile 25 in the housing 3.

A hollow launcher body 7 extends the barrel 2 on a side of its bottom 4, along the barrel axis A. The launcher body 7 comprises in particular a launcher tube 8 connected to the bottom 4 of the barrel 2 by a connection interface 9.

The launcher 1 also comprises a percussion set 10 involved in the projection of the projectile 25. The percussion set 10 comprises a cylindrical launch rod 11 of circular section along the barrel axis A. The launch rod 11 extends in the housing 3 of the barrel 2 from the bottom 4 to a free end 12 arranged facing the mouth 5. The free end 12 has a bearing surface 13 substantially transversal with respect to the barrel axis A, and a recess 14 arranged in the bearing surface 13. The percussion set 10 comprises also a percussion device 15 arranged in the housing 3 and in the launcher tube 8 of the launcher body 7 and coupled to a control assembly 19 arranged in the launcher tube 8 of the launcher body 7. The percussion device 15 comprises a percussion tip 16 mounted to be movable in the launch rod 14 between a retracted position, wherein the percussion tip 16 is located in the recess 14 of the free end 12 of the launch rod 11, and a priming position, wherein the percussion tip 16 protrudes in relation to the bearing surface 13 of the free end 12 of the launch rod 11. In particular, the percussion tip 16 is carried by a pin 17 slidably mounted along the barrel axis A inside a housing of the launch rod 11. The pin 17 is urged to an advanced position by one or several elastic members, such as helical springs 18, and retained in a rearward position by a hook 20 of the control assembly 19 placed in the launcher tube 8 of the launcher body 7. The percussion tip 16 is in the priming position when the pin 17 is in the advanced position, and in the retracted position when the pin 17 is in the rearward position. The displacement of the hook 20 in order to release the pin 17 and switch the percussion tip 16 from the retracted position to the priming position is controlled by an actuating member of the control assembly 20 that can be actuated by the operator.

Opposite the barrel 2, the launcher tube 8 of the launcher body 7 has an articulated leg 21 that makes it possible to set the launcher 1 on the ground, where applicable by orienting it, with the inclination of the launcher 1 being given by the intermediary of a clinometer 22 mounted on the launcher body 7.

In FIG. 2, the projectile 25 is an explosive grenade comprising an operating head 26, a body 28 and a tail 40 adjoining along a projectile axis B. The projectile 25 has a caliber, i.e. a maximum outer dimension, of 51 mm and a weight between 750 g and 1000 g.

The operating head 26, for example of the type of rocket operated under the name FLAME by the company JUNG-HANS Microtec GmbH, comprises an explosive charge and is made integral, for example by screwing, directly or, as shown in FIG. 2, by means of a spacer 27, to a first end 28*a* of the body 28.

The corps 28 comprises a cylindrical fragment-generating sleeve 29 of circular section along the projectile axis B and of which a first end 29*a* forms the first end 28*a* of the body 28. The fragment-generating sleeve 29, made from steel, has an inner surface of circular section. The inner surface is provided with first grooves in the form of threads 31 extending substantially circumferentially, and with second grooves in the form of channels 32 extending substantially axially. In particular, the fragment-generating sleeve 29 has an outer diameter of 51 mm and an inner diameter of 45 mm and the inner surface has threads 31 carried out with a pitch of 4 mm and twenty to thirty channels 32. Alternatively, any other arrangement of first and second grooves extending respectively according to the first and second secant directions could be provided on the inner surface of a fragment-generating sleeve 29 of any suitable shape.

The body 28 also comprises a connector 35 extending along the projectile axis B from a first end 35*a* integral, for example via screwing, with a second end 29*b* of the fragment-generating sleeve 29 opposite the first end 29*a*. The connector 35 has a central bore 36, blind on the side of the first end 35*a* and opened on a second end 35*b* opposite the first end 35*a* and forming a second end 28*b* of the body 28.

The tail 40 is integral with the second end 28*b* of the body 28. In particular, the tail 40 comprises a tube 41 adapted to be mounted on the launch rod 11. The tube 41 of the projectile 25, made from an aluminum alloy, has a first end 41*a* screwed into the bore 36 of the connector 35 of the body 28, and a second end 41*b* opposite the first end 41*a*. The tube 41 also has an inner cylindrical surface 42 of circular section along the projectile axis B. The inner surface 42 has an inner diameter Di corresponding substantially to the outer diameter of the launch rod 11 of the launcher 1. The inner diameter Di is substantially constant over a stroke c along the projectile axis B between a first location E1 located in the vicinity of the first end 41*a* of the tube 41 and a second location E2 separate from the first location E2 and located, in the embodiment shown, in the vicinity of the second end 41*b* of the tube 41. Alternatively, any other arrangement of the first location E1, of the side of the operating head 26 and of the second location E2 at a distance from first location E1 in order to define an appropriate stroke c could be provided. By way of example, the inner diameter Di of the inner surface 42 is between 21.5 mm and 22.5 mm, in particular 22.05 mm. The tube 41 has a length, measured along the projectile axis B, between 140 mm and 160 mm, in particular 150 mm, in such a way that the stroke c between the first E1 and second E2 locations can be between 120 mm and 110 mm, in particular 115 mm. The tube 41 has, moreover, a thickness e in the vicinity of the first location E1 between 4.6 mm and 5 mm, in particular 4.8 mm. In the vicinity of the second end 41*b*, an empennage 43 is provided on an outer surface of the tube 41 in order provide stability during a firing.

The first end 41*a* of the tube 41 is closed in a sealed manner by a sealing element. In the embodiment shown, the sealing element has the form of a plug 44 arranged in a bottom 37 of the bore 36 of the connector 35 of the body 28 and in contact with the tube at its first end 41*a*.

Opposite, a stopper element is integral with the second end 41*b* of the tube 41. The stopper element is carried out in the form of a cylindrical retaining ring 45 along the projectile axis B. The retaining ring 45 comprises a first portion 46 screwed onto the second end 41*b* of the tube 41 and a second portion 47 extending the tube 41 beyond its second end 41*b* along the projectile axis B. The second portion 47 of the retaining ring 45 has an inner tapered surface 48 of circular section converging towards the projectile axis B when moving away from the second end 41*b* of the tube 41. The second portion 47 of the retaining ring 45 as such interiorly defines a restriction 49 that has a diameter less than the inner diameter Di of the inner surface 42 of the tube 41 along the stroke c. An insert 50 can be mounted in a removable manner on the second portion 47 of the retaining ring 45 in order to close the access to the inside of the tube 41 before use of the projectile 25.

In FIG. 2, the projectile 25 also comprises a piston 60 mounted in the tube 41 and positioned at the first location E1 of the stroke c formed on the inner surface 42 of the tube 42, in the vicinity of the first end 41*a* of the tube 41. The piston 60 comprises a transverse wall 61 with respect to the projectile axis B and adapted to rest on the bearing surface 13 of the free end 12 of the launch rod 11. It also comprises a skirt 62 that extends perpendicularly to a peripheral edge of the transverse wall 61 towards the plug 44 forming sealing element. The skirt 62 has an outer cylindrical surface of circular section, placed in sealed contact with the inner surface 42 of the tube 41 and adapted to slide along the inner surface 42 of the tube 41 along the projectile axis B until the second location E2. The skirt 62 also has an inner cylindrical surface of circular section defining, with an upper surface of the transverse wall 61, a recess 63 open towards the plug 44. The recess 63 can in particular have a volume between 2 cm3 and 4.5 cm3, in particular 2.5 cm3. The piston 60 further comprises a primer 64 arranged in a substantially central manner in the transverse wall 61 is such a way as to be able to be activated by the percussion tip 14 in priming position when the piston 60 is resting on the bearing surface 13 of the free end 12 of the launch rod 11. The piston 60 defines, with the tube 41 and the plug 44, a hermetically-sealed propulsion chamber 65 of which the volume increases as the piston 60 is moved from the first location E1 to the second location E2.

A propulsion charge 70 is placed in the propulsion chamber 65 when the piston 60 is at the first location E1. The propulsion charge 70 is adapted to be activated by the primer 64 of the piston 60 in order to move the piston 60 between the first E1 and second E2 locations. In particular, the propulsion charge 70 comprises between 2.4 g and 3.7 g, even between 2.4 g and 3.6 g of a powder having a heat of combustion between 3500 J/g and 4000 J/g. In the embodiment shown, the powder is entirely placed in the recess 63 of the piston 60 with a loading density between 0.9 g and 1.2 g per cm3, in particular 0.96 g per cm3. The powder can in particular be the same powder as that which is used in the grenade operated by the company CATHYOR ENGINEERING S.A. under the name Fly-K®, namely a P3T spherical powder developed by the company PB CLERMONT.

Figure 3:
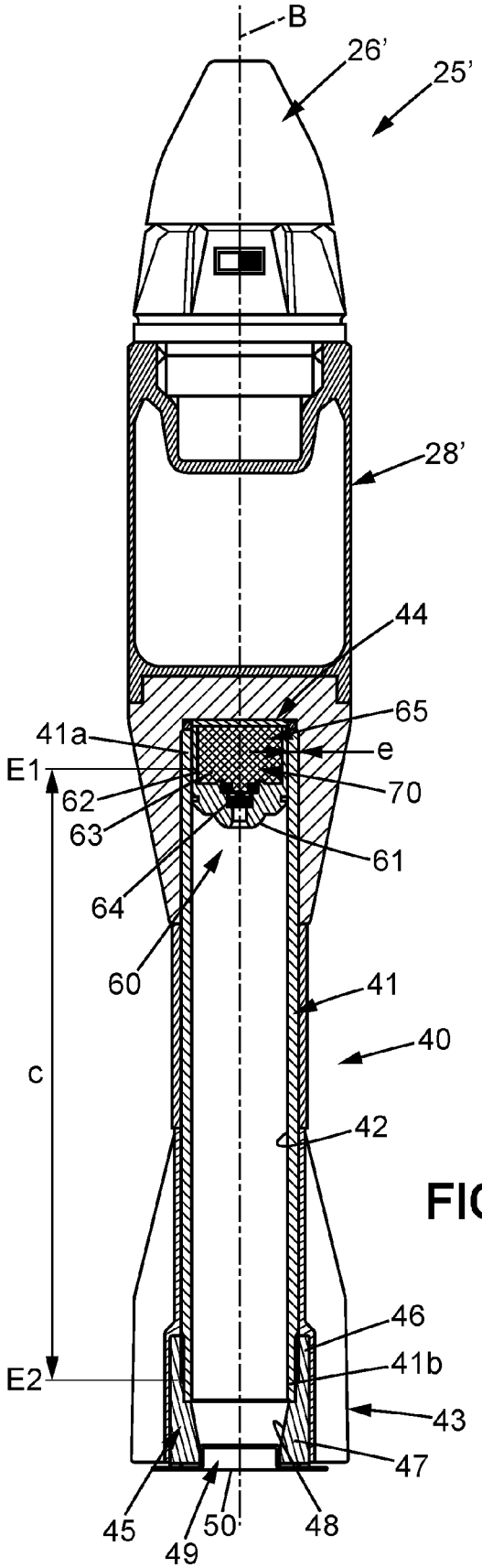
Figure 4:
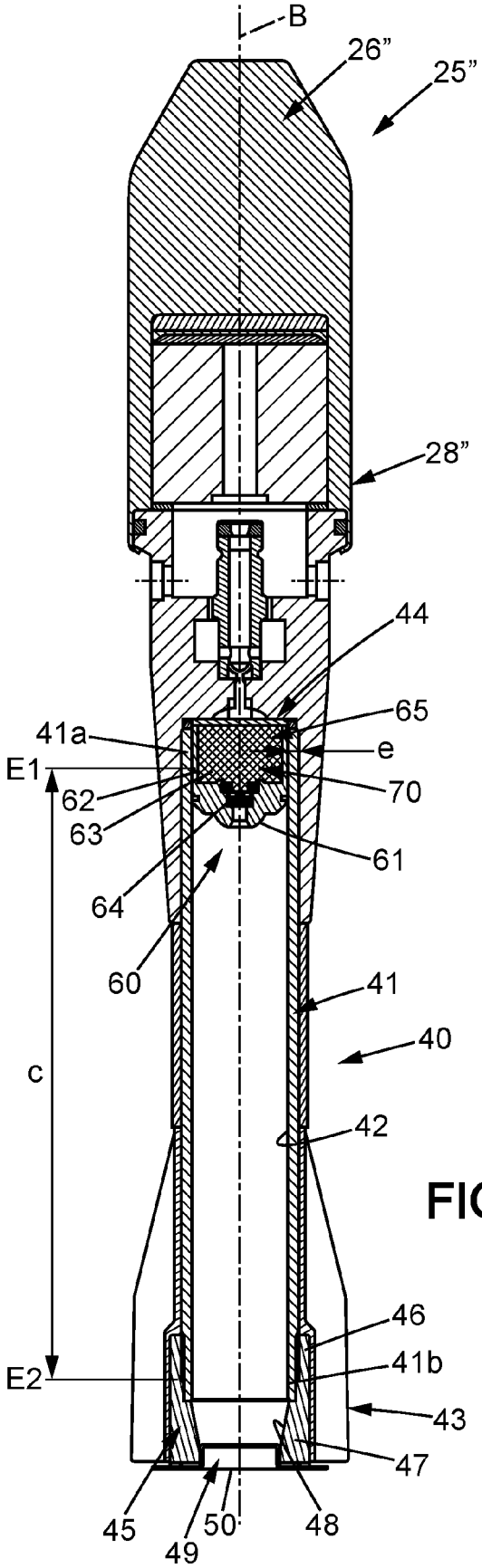

The weapon equipment according to the invention is not limited to an explosive grenade 25 of the type described hereinabove as a projectile. Alternatively, other projectiles of a caliber and weight compatible with the launcher 1 can be provided. By way of a non-limiting example, FIG. 3 shows a smoke grenade 25' of which the operating head 26' and the body 28' are adapted to produce a cloud of smoke. FIG. 4 shows an exercise grenade 25" of which the operating head 26" and the body 28" are adapted in order to make it possible to mark the trajectory and to mark the impact of the grenade 25" on the ground. The tail 40 of the projectiles 25', 25" is identical to that of the explosive grenade 25 described hereinabove in such a way as to be able to cooperate with the launch rod 11 and the percussion device 15 of the launcher 1.

Figure 5:
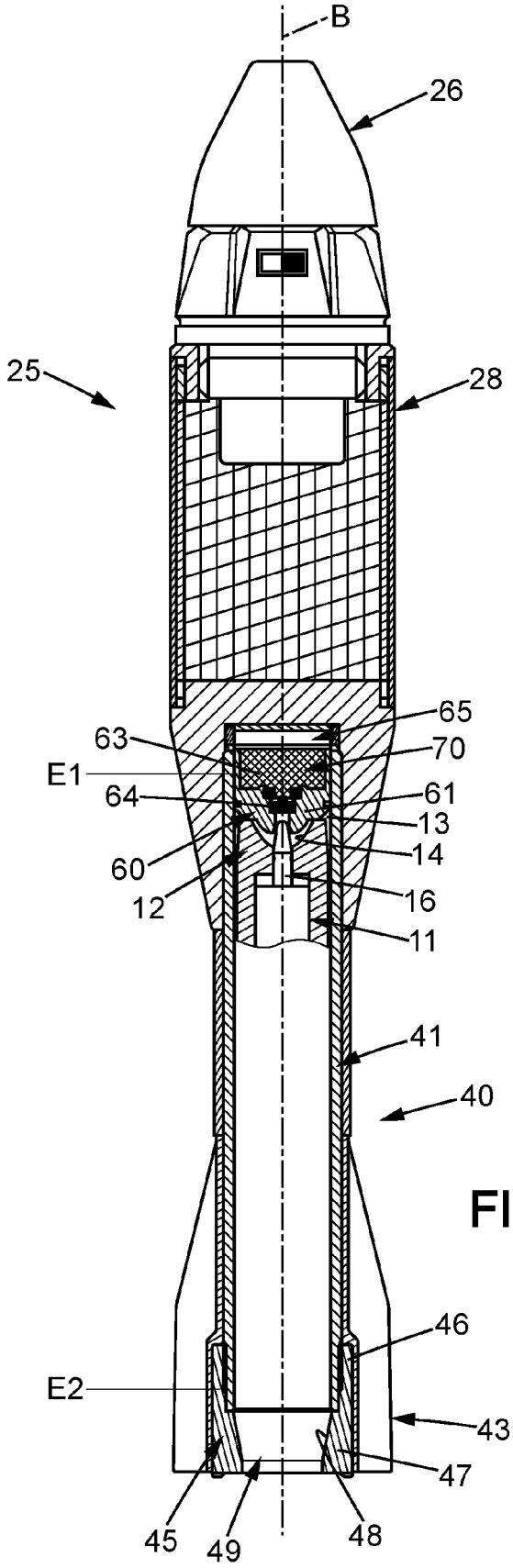
Figure 6:
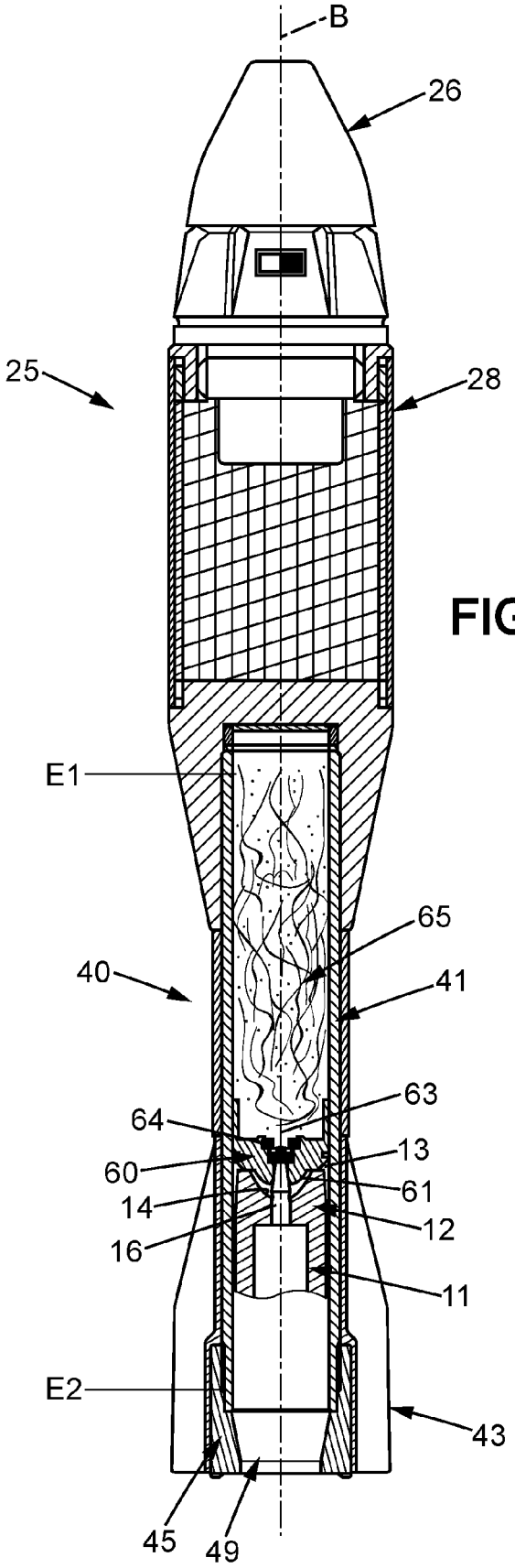

In relation with FIGS. 5 and 6, a use of the weapon equipment is described. In the FIGS. 5 and 6, only a portion in the vicinity of the free end 12 of the launch rod 11 of the launcher 1 is shown.

The projectile, for example the explosive grenade 25 of FIG. 2, is placed in the barrel 2 of the launcher 1 by the operator after the latter has removed the insert 50 mounted on the retaining ring 45. In particular, the projectile 25 is introduced by the tail 40 in the housing 3 of the barrel 2 through the mouth 5. The tube 41 of the tail 40 slides over the launch rod 11 until the transverse wall 61 of the piston 60 bears against the bearing surface 13 of the free end 12 of the launch rod 11. Doing this, the leaf springs 6 of the retaining device are deformed and are solicited back into a rest position wherein they retain the projectile 25 in the barrel 2 on the tail 40, above the empennage 43. The percussion tip 16 is in the retracted position.

In order to carry out a firing, the operator actuates the control assembly 19 that causes the percussion tip 16 to pass from the retracted position to the priming position. In this priming position, the percussion tip 16 activates the primer 64 of the piston 60 which, in turn, activates the propulsion charge 70. The projectile 25 is then displaced in relation to the piston 60 bearing on the free end 12 of the launch rod 11 in such a way that the piston 60 slides from the first location E1 to the second location E2 where it is retained by the restriction 49 of the retaining ring 45. The propulsion chamber 65 remains hermetically sealed, containing as such the flame and the smoke in order to suppress the light and reduce the noise and the heat emitted during the firing. The projectile 25 then leaves the barrel 2 of the launcher 1 to be protected at a distance from the launcher 1 and in particular at a distance ranging up to 1000 m.

The invention claimed is:

1. Weapon equipment comprising a launcher and at least one projectile intended to be projected at a distance by the launcher, wherein the launcher comprises:

a cylindrical barrel along a barrel axis, with the barrel comprising a housing adapted to receive at least one portion of the projectile, and a mouth adapted to allow for a passage of the projectile, a launch rod extending in the housing of the barrel along the barrel axis and having a free end facing the mouth of the barrel, the free end having a bearing surface and a recess arranged in the bearing surface, a percussion device comprising a percussion tip mounted to be movable in the launch rod between a retracted position, wherein the percussion tip is arranged in the recess, and a priming position, wherein the percussion tip protrudes in relation to the bearing surface, wherein the projectile has a weight between 750 g and 1000 g and extends along a projectile axis, the projectile comprising an operating head and a tail that extends the operating head along the projectile axis, the tail comprising:

a tube adapted to be mounted on the launch rod, with the tube being made of an aluminum alloy and having an inner cylindrical surface of circular section along the projectile axis, the inner surface having a constant inner diameter over a stroke along the projectile axis between a first location located on a side of the operating head and a second location separate from the first location, the inner diameter being between 21.5 mm and 22.5 mm, the stroke being between 110 mm and 120 mm, the tube having a thickness in the vicinity of the first location between 4.6 mm and 5 mm, a sealing element closing the tube in a sealed manner in a vicinity of the first location, a piston placed in the tube in sealed contact with the inner surface of said tube and adapted to rest on the bearing surface of the free end of the launch rod, the piston comprising a primer arranged to be activated by the percussion tip in priming position when the piston is resting on the bearing surface of the free end of the launch rod, the piston defining with the tube and the sealing element a hermetically-sealed propulsion chamber, with the piston being placed at the first location and able to be moved to the second location, a propulsion charge placed in the propulsion chamber when the piston is at the first location and which can be activated by the primer of the piston in order to move the piston bearing on the bearing surface of the free end of the launch rod from the first location to the second location, the propulsion charge comprising a powder having a heat of combustion between 3500 J/g and 4000 J/g, a stopper element adapted to retain the piston in the tube at the second location, wherein the propulsion charge has a mass strictly greater than 2.4 g and less than 3.7 g.

2. Weapon equipment according to claim 1, wherein the piston has a recess open towards the sealing element, and wherein the powder of the propulsion charge is entirely placed in the recess of the piston with a loading density between 0.9 g and 1.2 g per $cm^3$.

3. Weapon equipment according to claim 1, wherein the projectile has a caliber of 51 mm.

4. Weapon equipment according to claim 1, wherein the tube of the projectile has opposite first and second ends in the vicinity of the first and second locations.

5. Weapon equipment according to claim 1, wherein the projectile further comprises a body adjoining the head, with the head comprising an explosive charge and the body comprising a fragment-generating sleeve, with the fragment-generating sleeve being cylindrical along the projectile axis and having an inner surface, the inner surface being provided with first and second grooves extending respectively according to first and second secant directions.

6. Weapon equipment according to claim 5, wherein the first grooves are threads extending substantially circumferentially and the second grooves are channels extending substantially axially.

7. Weapon equipment according to claim 5, wherein the fragment-generating sleeve has an outer diameter of 51 mm and an inner diameter of 45 mm, and wherein the inner surface of the fragment-generating sleeve has threads carried out with a pitch of 4 mm and twenty to thirty channels.

8. Weapon equipment according to claim 5, wherein the fragment-generating sleeve is made from steel.

9. Weapon equipment according to claim 1, wherein the launcher can be carried by hand by an operator.

10. Projectile specially adapted for weapon equipment, the projectile having a weight between 750 g and 1000 g and extending along a projectile axis, the projectile comprising an operating head and a tail which extends the operating head along the projectile axis, the tail comprising:

a tube adapted to be mounted on a launch rod of a launcher, with the tube being made of an aluminum alloy and having an inner cylindrical surface of circular section along the projectile axis, the inner surface having a constant inner diameter over a stroke along the projectile axis between a first location located on a side of the operating head and a second location separate from the first location, the inner diameter being between 21.5 mm and 22.5 mm, the stroke being between 110 mm and 120 mm, the tube having a thickness in the vicinity of the first location between 4.6 mm and 5 mm, a sealing element closing the tube in a sealed manner in the vicinity of the first location, a piston placed in the tube in sealed contact with the inner surface of said tube and adapted to rest on a bearing surface of a free end of the launch rod of the launcher, the piston comprising a primer arranged in order to be activated by a percussion tip in priming position of a percussion device of the launcher when the piston is resting on the bearing surface of the free end of the launch rod of the launcher, with the piston defining with the tube and the sealing element a hermetically-sealed propulsion chamber, with the piston being placed at the first location and able to be moved to the second location, a propulsion charge placed in the propulsion chamber when the piston is at the first location and which can be activated by the primer of the piston in order to displace the piston bearing on the bearing surface of the free end of the launch rod of the launcher from the first location to the second location, the propulsion charge comprising a powder having a heat of combustion between 3500 J/g and 4000 J/g, a stopper element adapted to retain the piston in the tube at the second location, wherein the propulsion charge has a mass strictly greater than 2.4 g and less than 3.7 g.

11. Projectile of claim 10, wherein said inner diameter of said tube is 22.05 mm.

12. Projectile of claim 10, wherein said stroke is 115 mm.

13. Projectile of claim 10, wherein said thickness of the tube is 4.8 mm.

14. Projectile of claim 10, wherein said propulsion charge has a mass less than 3.6 g.

15. Projectile of claim 10, wherein the powder of the propulsion charge comprises P3T spherical powder.

16. Weapon equipment of claim 1, wherein said inner diameter of said tube is 22.05 mm.

17. Weapon equipment of claim 1, wherein said stroke is 115 mm.

18. Weapon equipment of claim 1, wherein said thickness of the tube is 4.8 mm.

19. Weapon equipment of claim 1, wherein said propulsion charge has a mass less than 3.6 g.

20. Weapon equipment of claim 1, wherein the powder of the propulsion charge comprises P3T spherical powder.

* * * * *